US007314437B2

(12) United States Patent
Frappier

(10) Patent No.: US 7,314,437 B2
(45) Date of Patent: Jan. 1, 2008

(54) TRAINING HARNESS FOR ATHLETIC HITTING AND SWINGING SKILLS

(75) Inventor: John P. Frappier, Horace, ND (US)

(73) Assignee: Acceleration Products, Inc., Fargo, ND (US)

( * ) Notice: Subject to any disclaimer, the term of this patent is extended or adjusted under 35 U.S.C. 154(b) by 0 days.

(21) Appl. No.: 11/101,310

(22) Filed: Apr. 7, 2005

(65) Prior Publication Data

US 2006/0229175 A1 Oct. 12, 2006

(51) Int. Cl.
*A63B 21/02* (2006.01)

(52) U.S. Cl. ..... 482/124; 482/126

(58) Field of Classification Search ..... 482/69, 482/121–130; 473/131
See application file for complete search history.

(56) References Cited

U.S. PATENT DOCUMENTS

| | | | | | |
|---|---|---|---|---|---|
| 4,593,909 | A * | 6/1986 | Anselmo et al. | ..... | 473/216 |
| 5,167,601 | A | 12/1992 | Frappier | | |
| 5,186,701 | A * | 2/1993 | Wilkinson | ..... | 482/125 |
| 5,188,365 | A * | 2/1993 | Picard | ..... | 473/213 |
| 5,221,089 | A | 6/1993 | Barrett | | |
| 5,451,060 | A * | 9/1995 | Dalbo | ..... | 473/215 |
| 5,518,480 | A * | 5/1996 | Frappier | ..... | 482/124 |
| 5,704,856 | A | 1/1998 | Morse | | |
| 5,791,351 | A * | 8/1998 | Curchod | ..... | 600/595 |
| 5,795,238 | A * | 8/1998 | Nicholson | ..... | 473/214 |
| 5,993,362 | A * | 11/1999 | Ghobadi | ..... | 482/124 |
| 6,012,993 | A * | 1/2000 | Guerriero | ..... | 473/424 |
| 6,050,963 | A * | 4/2000 | Johnson et al. | ..... | 600/595 |
| 6,099,446 | A * | 8/2000 | Johnson et al. | ..... | 482/124 |
| 6,176,790 | B1 | 1/2001 | Latella | | |
| 6,213,922 | B1 * | 4/2001 | Afanasenko et al. | ..... | 482/124 |
| 6,517,446 | B2 * | 2/2003 | Waddell | ..... | 473/277 |
| 6,612,845 | B1 * | 9/2003 | Macri et al. | ..... | 434/247 |
| 6,652,427 | B2 | 11/2003 | Wroclawsky | | |
| 6,837,830 | B2 * | 1/2005 | Eldridge | ..... | 482/54 |
| 2006/0199706 | A1 * | 9/2006 | Wehrell | ..... | 482/92 |

* cited by examiner

*Primary Examiner*—Lori Amerson
(74) *Attorney, Agent, or Firm*—Faegre & Benson LLP

(57) ABSTRACT

A harness for training the muscles used during hitting and swinging athletic movements comprising an arm portion, the arm portion comprising a pair of arm members for engaging a trainee's arms, wherein each arm member comprises a lower arm band adapted for positioning around the trainee's lower arm, a waist portion for engaging a midsection of the trainee's body, a leg portion, the leg portion comprising a pair of leg members for engaging the trainee's legs, wherein each leg member comprises a thigh band adapted for positioning around the trainee's thigh and a leg connecting web connecting the thigh band to the waist portion, a resilient and extensible arm tether extending from each lower arm band to the waist portion; and a resilient and extensible leg tether extending from each leg connecting web for connection to a restraint structure.

11 Claims, 6 Drawing Sheets

TRAINING HARNESS FOR ATHLETIC HITTING AND SWINGING SKILLS

TECHNICAL FIELD

This invention relates to devices used for athletic training. This invention relates more particularly to a device for strengthening and training the muscles used during hitting movements.

BACKGROUND

Detailed anatomical study and training of athletes engaging in sports involving hitting or swinging movements, such as golf, softball, and baseball, have indicated that the muscles associated with such actions require specialized strengthening and training. Athletic training devices utilizing resilient and extensible tethers, connecting webs, and bands for training specific muscle groups are well known in the athletic training art. By way of example, a device for training the upper body is described in U.S. Pat. No. 5,518,480 to Frappier, herein incorporated by reference. This device is used to provide resistance to the arms, trunk and shoulders to improve performance in sports such as hockey, basketball, volleyball and baseball/softball. A device for training the lower body is described in U.S. Pat. No. 5,167,601 to Frappier, which is incorporated herein by reference. This device provides resistance to the lower extremities during sprinting and related motions.

It is also known to combine two lower body training devices of the type shown in U.S. Pat. No. 5,167,601 to provide resistance to certain muscles used during hitting and swinging movements that require rotation of the hips. These lower body training devices include a thigh band, a calf band, a web connecting the thigh and calf band, and a resilient and extensible tether attached to the web and adapted for attachment to a restraint structure. By connecting the thigh bands of the two devices together around an athlete's waist, and connecting each calf band to the athlete's thighs, resistance is provided to the muscles used during hitting and swinging movements through the tethers, which are attached to a restraint structure.

There remains a need for an improved athletic training device for training the muscles used during hitting and swinging movements. A device capable of strengthening many of the muscles used during these hitting and swinging movements would be desirable. A device of this type that enhances the sequence of related body muscles recruitment would be especially desirable.

SUMMARY

The present invention is an improved hitting and swinging movement training device that can strengthen muscles throughout the body and enhance the sequence of muscle recruitment. One embodiment of the invention includes an arm portion, comprising one or more arm members for engaging one or both of a trainee's arms, a waist portion for engaging a midsection of the trainee's body, and a leg portion, comprising one or more leg members for engaging one or both of the trainee's legs. A resilient and extensible arm tether extends from each arm member to the waist portion, and a resilient and extensible leg tether extends from each leg member for connection to a restraint structure.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

Figure 1:
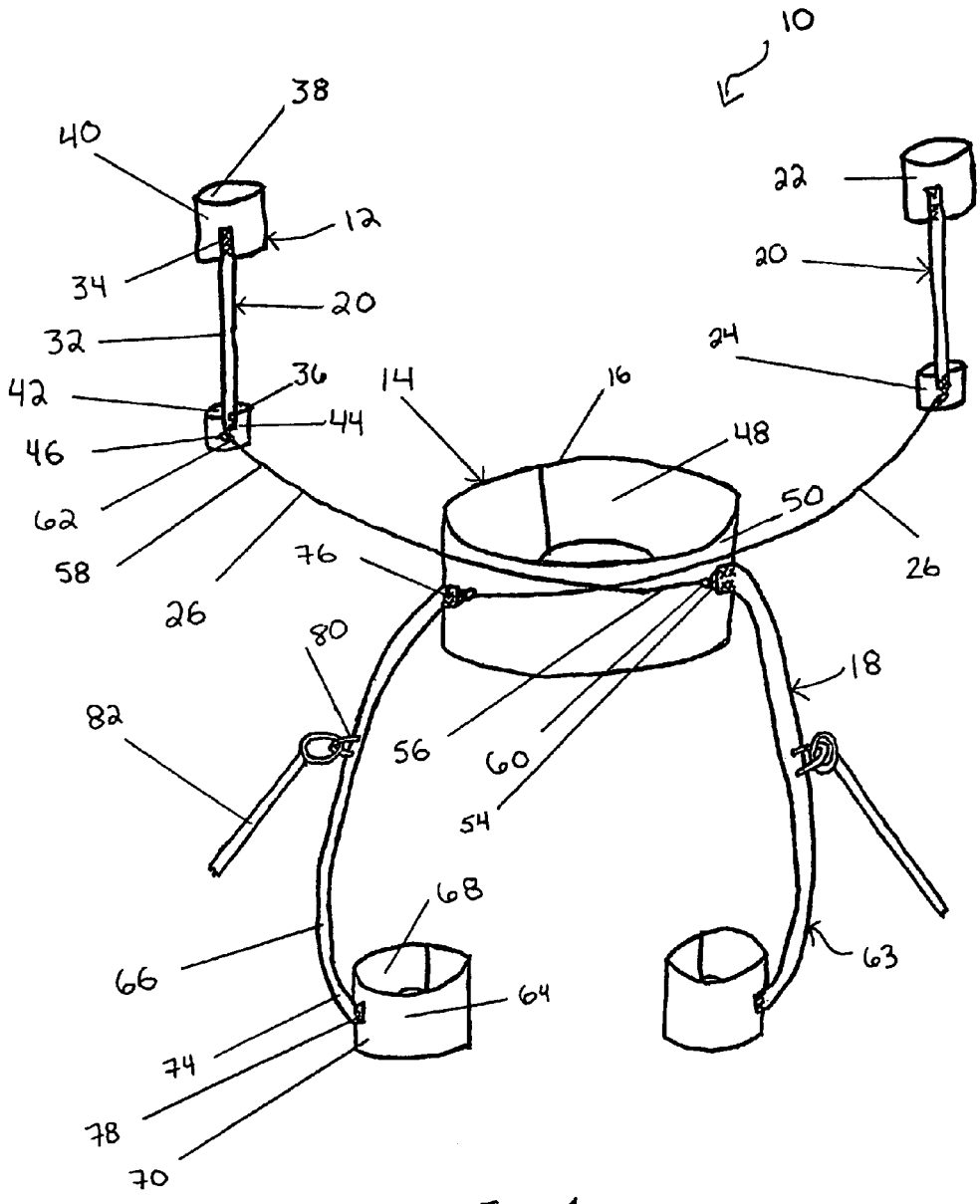
FIG. 1 is a rear perspective view of one embodiment of the hitting harness of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

FIG. 1 is a rear perspective view of one embodiment of the hitting harness 10 of the present invention. As shown, the hitting harness 10 includes an arm portion 12 and a lower body portion 14. The lower body portion 14 includes a waistband 16 and a leg portion 18. The arm portion 12 includes a pair of arm members 20. Each arm member 20 includes an upper arm band 22 and a lower arm band 24. Arm tethers 26 connect the arm members 20 to the waistband 16. The upper arm bands 22 are configured to engage an upper arm 28 of a trainee 29 (shown in FIG. 2). The lower arm bands 24 are configured to engage the lower arm 30 (also shown in FIG. 2). Each upper arm band 22 is connected to a lower arm band 24 by an arm connecting web 32. In the embodiment shown in FIG. 1, arm connecting webs 32 are attached to upper arm bands 22 by tack stitching 34 and to lower arm bands 24 by tack stitching 36. The arm connecting webs 32 may be attached to the upper arm bands 22 and the lower arm bands 24 in any other suitable manner.

The upper arm bands 22 have an interior side 38 and an exterior side 40. The lower arm bands 24 similarly have an interior side 42 and an exterior side 44. The interior sides 38, 42 can be made of a padded material while the exterior sides 40, 44 can be made of a stretchable fabric. The materials used to make the interior side 38 and the exterior side 40 of upper arm bands 22 can be joined together. The interior side 42 and the exterior side 44 of lower arm bands 24 can be joined together in a similar manner. The arm bands 22, 24 can be adjustably secured around the upper arms 28 and lower arms 30, respectively, by any suitable structure. In one embodiment, the arm bands 22, 24 are elongate members that wrap around the upper arms 28 and lower arms 30, respectively, and are releasably secured in the wrapped position by a hook and loop fastener. Alternatively, the arm bands 22, 24 could be secured using buckles, ties, or other suitable structure.

In the embodiment shown in FIG. 1, the lower arm bands 24 include connectors 46 for connecting to the waistband 16.

The connectors 46 can also be located on the upper arm bands 22 or on the connecting webs 32. The location of the connectors 46 along the connecting webs 32 controls the distribution of the resilient force of arm tethers 26 between the upper arm bands 22 and the lower arm bands 24. The arm tethers 26 can be made of any elongated elastomeric and stretchable material long enough to allow for a sufficient range of motion while providing desired amounts of resistance to the arm muscles. In alternative embodiments, other structures, such as additional tethers, can be used to provide different force distribution across the upper body.

The waistband 16 has an interior side 48 and an exterior side 50. The interior side 48 can be made of any padded material and the exterior side 50 can be made of any stretchable fabric. The interior side 48 can be joined to the exterior side 50. The waistband 16 can be secured by any suitable structure and is adjustable. In one embodiment, the waistband 16 is an elongate member that wraps around the trainee's waist 52 and is releasably secured in the wrapped position by a hook and loop fastener. Alternatively, the waistband 16 could be secured using buckles, ties, or other structure. The waistband 16 includes connectors 54 located for connection to the arm tethers 26. Although a waistband 16 is shown in FIG. 1, other structures that are secured to other mid-body portions of the trainee could also be used.

Each arm member 20 is connected to the waistband 16 by the arm tethers 26. The arm tethers 26 have a waist end 56 and an arm end 58. A waist connector 60 is located at the waist end 56 and is adapted for connection to the connector 54. An arm connector 62 is located at the arm end 58 and is adapted for connection to the connector 46.

The leg portion 18 includes leg member 63. Each leg member 63 includes a thigh band 64 connected to the waistband 16 by a leg connecting web 66. The thigh bands 64 have interior sides 68, which can be made of a padded material, and can be joined to the exterior sides 70, which can be made of a stretchable material. In one embodiment, the thigh bands 64 comprise an elongate member and are adjustably and releasably secured using hook and loop closures. Alternatively, the thigh bands 64 could be secured using buckles, ties, or other structure. The leg connecting webs 66 are long enough to allow for a sufficient range of leg motion. Each leg connecting web 66 includes a waist end 72 and a thigh end 74. In the embodiment shown in FIG. 1, the waist ends 72 are attached to the waist band 16 by tack stitching 76 and the thigh ends 74 are attached to the thigh bands 64 by tack stitching 78. The leg portion 18 also includes connectors 80, adapted for connection to resilient and extensible leg tethers 82.

Figure 2:
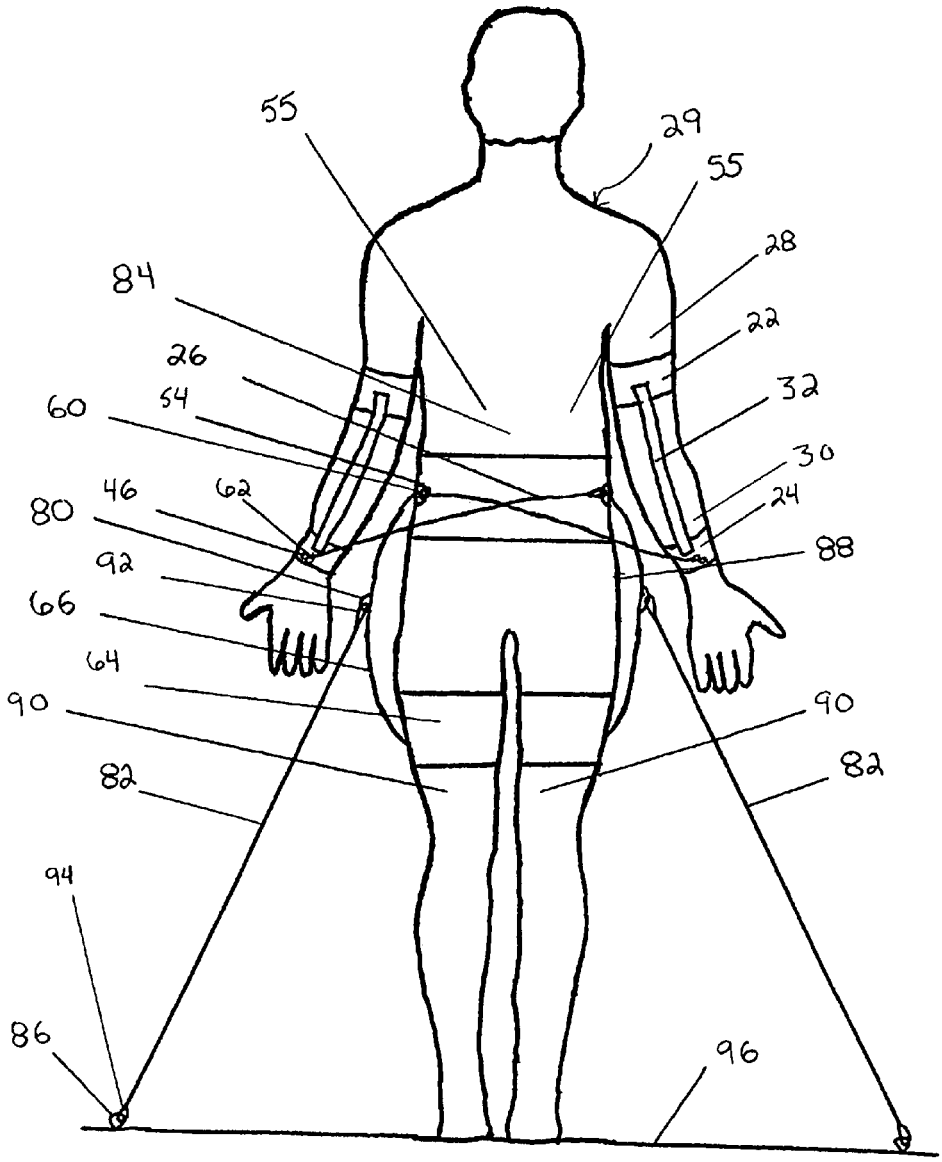
FIG. 2 is a rear view of a trainee wearing the hitting harness shown in FIG. 1.

FIG. 2 is a rear view of a trainee 29 wearing the hitting harness 10 of FIG. 1. As shown in FIG. 2, each arm connecting web 32 extends from the upper arm band 22 to the lower arm band 24. The arm connecting webs 32 allow for a full range of arm motion. In the embodiment shown in FIG. 2, each arm tether 26 extends from the connector 46 on the arm member 20 across the trainee's back 84 to the opposing connector 54 located on the waistband 16. The force distribution on the trainee's 29 arms can be controlled by varying the location of the connectors 54 on the waistband 16. The force distribution on the arms can also be controlled by using additional tethers 26 or elastic cords or by extending the tethers 26 from different locations on the hitting harness 10. In one embodiment, the hitting harness 10 includes a connector 55 located at the center of the back of the waistband 16 and connectors 47 located on the arm connecting webs 32. In this embodiment, the arm tethers 26 extend from the connector 55 to the connectors 47. The connectors 46, 47, 54, 55, 60, 62 can be made of plastic, metal, or any other suitable material. In one embodiment, the connectors 46, 47, 54, 55 can comprise D-rings and the connectors 60, 62 can comprise clips. Any number of connectors 46, 47, 54, 55 can be used as necessary.

As shown in FIG. 2, the leg tethers 82 extend from the connectors 80 on the leg connecting webs 66 to the restraint structures 86. The leg tethers 82 are comprised of a resilient and extensible material and allow for a sufficient range of motion while providing desired amounts of resistance to the hips 88 and legs 90. The connectors 80 can be made of plastic, metal, or any other suitable material. In one embodiment, the connectors 80 can comprise D-rings. The leg tethers 82 include web connectors 92 and restraint connectors 94 adapted for connecting to the connectors 80 and restraint structures 86, respectively. The location of the web connectors 92 along the connecting webs 66 controls the distribution of the resilient force of the leg tethers 82 to the hips 88 and legs 90. The web connectors 92 could also be located in other areas of the leg portion 18, including the thigh bands 64. In one embodiment, the connectors 92, 94 can comprise clips. The restraint structures 86 can be attached to the floor 96 or to any other suitable structure. In alternative embodiments, additional tethers 82 can be used to provide different force distributions across the lower body.

Figure 3:
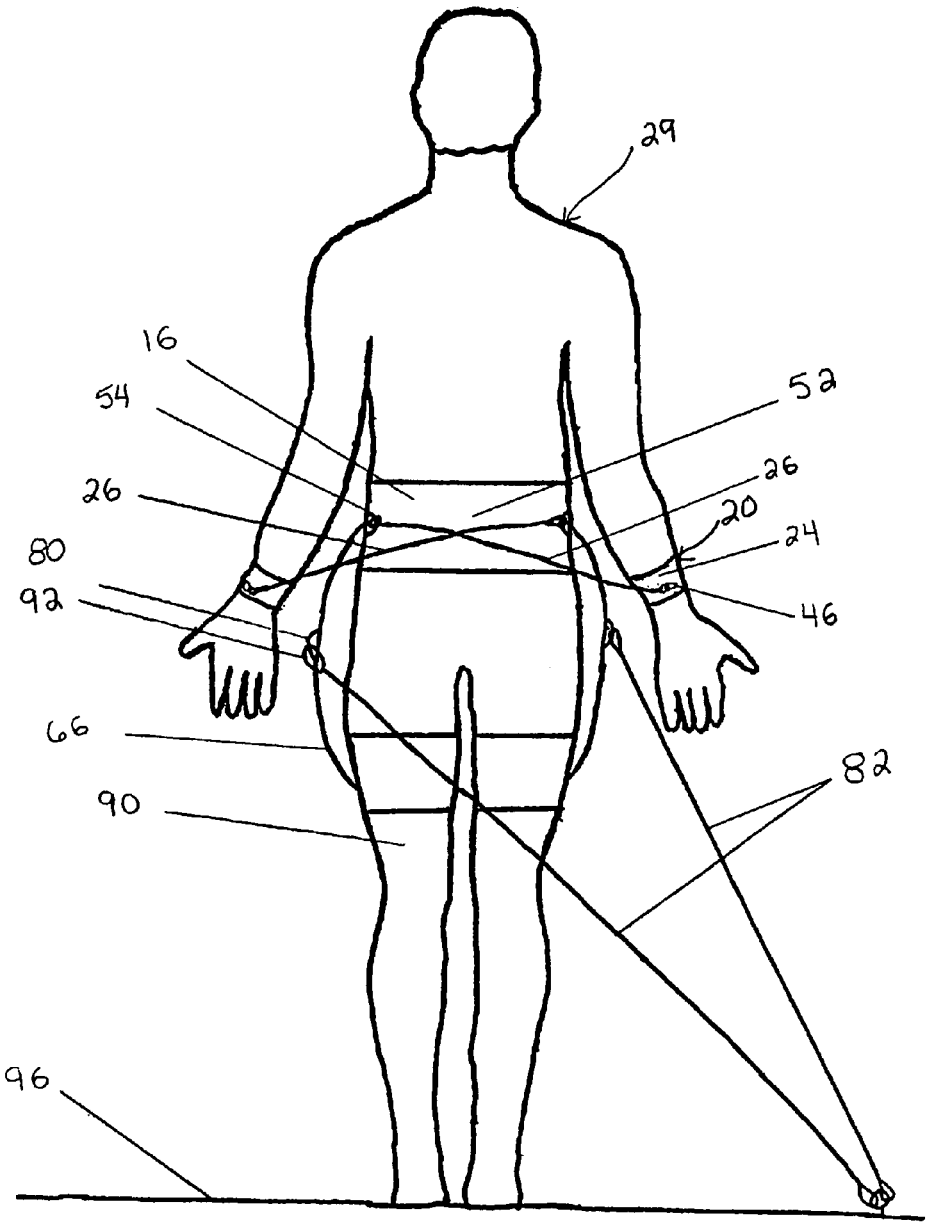
FIG. 3. is a rear view of a trainee wearing an alternative embodiment of the hitting harness of the present invention.

FIG. 3 is a rear view of a trainee 29 wearing another embodiment of the hitting harness 10. In this embodiment, each arm member 20 include a lower arm band 24. The arm tethers 26 extend from the connectors 46 on the lower arm bands 24 to the connectors 54 on the waistband 16. As shown in FIG. 3, the leg tethers 82 extend from the connectors 80 on the leg connecting webs 66 to a restraint structure 86. The restraint structure 86 can be attached to the floor 96 or to any other suitable structure. The restraint structure 86 can be located to either side of the trainee 29, behind the trainee 29, or on either side of and behind the trainee 29. Alternatively, one or more restraint structures 86 could be located on either side of the trainee 29, directly behind the trainee 29, or in any other suitable position.

Figure 4A:
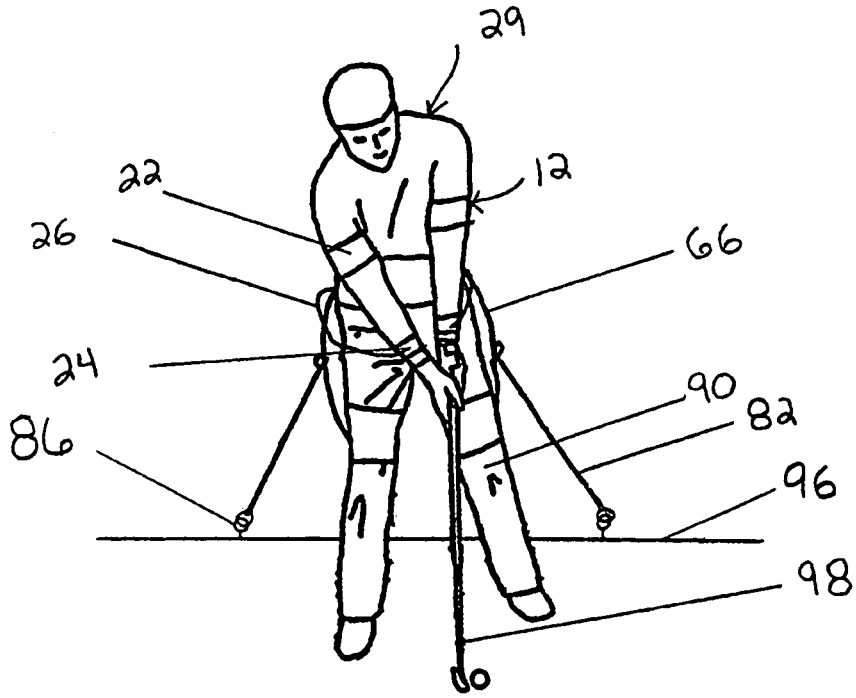
FIGS. 4A-4C illustrate the method by which a trainee such as that shown in FIG. 2 uses the hitting harness shown in FIG. 2.
Figure 4B:
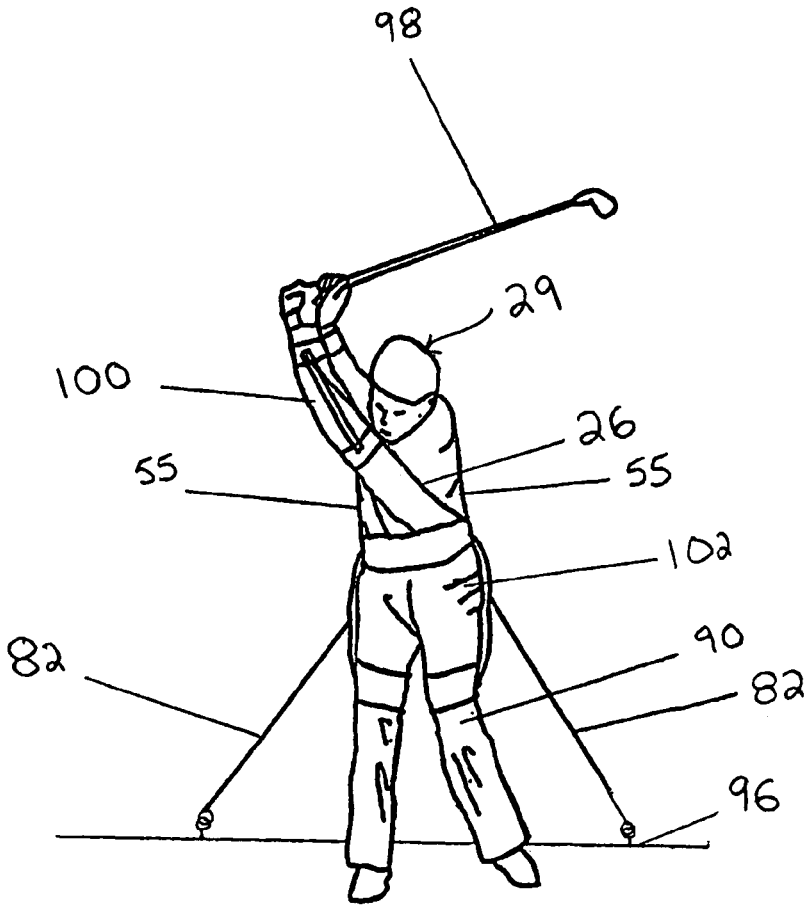
Figure 4C:
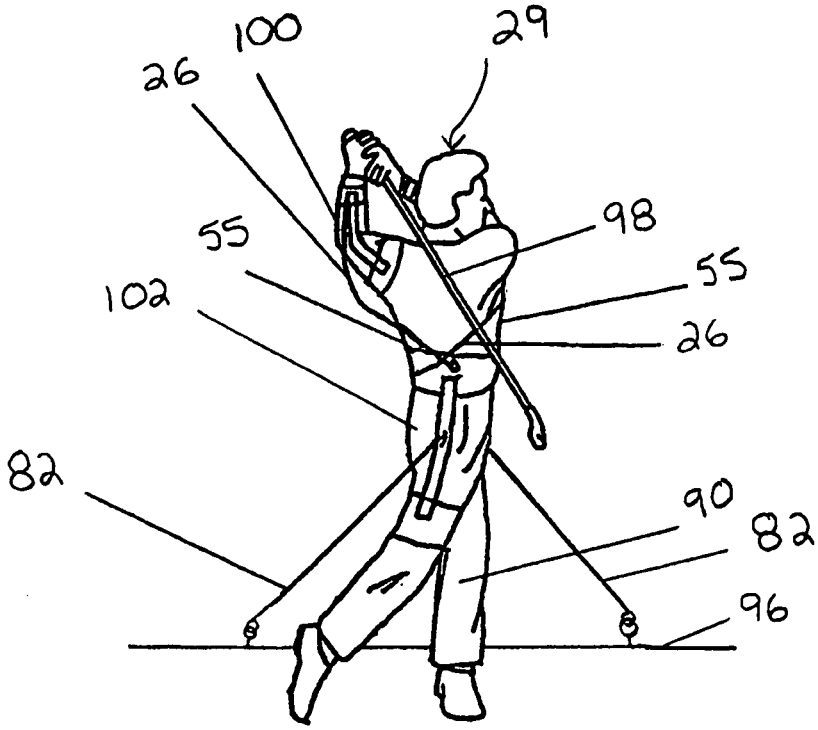

FIGS. 4A-4C show a method of training the muscles used during hitting and swinging movements using the hitting harness of FIG. 1. Although the swinging movement shown in FIGS. 4A-4C is a right-handed golf swing, the method shown is applicable to hitting a softball, baseball, or any other hitting or swinging movement. As shown in FIG. 4A, the trainee 29 is wearing the hitting harness 10, holding a golf club 98, and preparing to initiate the backswing. The leg tethers 82 extend from leg connecting webs 64 and are connected to restraint structures 86 located on the floor 96. The trainee 29 is in a neutral position. In this neutral position, the leg tethers 82 are under relatively lower tension. The arm tethers 26 extend from the lower arm bands 24 to the waistband 16. In this neutral position, the arm tethers 26 connecting the arm portion 12 to the waistband 16 are under relatively lower tension. As the trainee 29 moves from the neutral position to the backswing position (shown in FIG. 4B), the tension on the left arm tether 26 and the left leg tether 82 is increased.

FIG. 4B is a front view of the trainee 29 after the completion of the backswing and prior to initiating the down swing. Resistance is provided to the arms 100 through the arm tethers 26 and to the hips 88 and legs 90 through the leg tethers 82. Greater resistance is provided to the left side 55*a* than the right side 55*b* of the trainee 29. As the trainee 29 initiates the down swing and moves toward completion of the swing (shown in FIG. 4C), the tension on the left side 55*a* decreases and the tension on the right side 55*b* increases.

FIG. 4C is a front view of the trainee 29 at the completion of the swing. As shown, the trainee 29 has completed the rotation of his hips 102 and his swinging movement. The tension on the right side 55*b* is maximized at this point through the right arm tether 26 and the right leg tether 82. By using the present invention in this manner, the resistance applied to the arms 102, the hips 88, and the legs 90 throughout the swing strengthens and trains the associated muscles in the order they are used in the hitting or swinging motion.

Various modifications and additions can be made to the exemplary embodiments discussed without departing from the scope of the present invention. Accordingly, the scope of the present invention is intended to embrace all such alternatives, modifications, and variations as fall within the scope of the claims, together with all equivalents thereof.

I claim:

1. A harness for training the muscles used during hitting and swinging movements comprising:

an arm portion, the arm portion comprising one or more arm members for engaging one or both of a trainee's arms;

a waist portion for engaging a midsection of the trainee's body;

a pair of leg members, each leg member including a thigh band adapted for positioning around the trainee's thigh and connected to the waist portion by a leg connecting web;

a resilient and extensible arm tether extending from each arm member to the waist portion; and a resilient and extensible leg tether extending from the leg connecting web of each leg member for connection to a restraint structure.

2. The hitting harness of claim 1 wherein the arm portion comprises a pair of arm members, and each arm member further comprises a lower arm band adapted for positioning around the trainee's lower arm.

3. The hitting harness of claim 1 wherein the arm portion comprises a pair of arm members, and wherein each arm member comprises an upper arm band adapted for positioning around the trainee's upper arm, a lower arm band adapted for positioning around the trainee's lower arm, and an arm connecting web connecting the upper arm band to the lower arm band.

4. The hitting harness of claim 3 wherein the arm tethers extend from the lower arm bands to the waist portion.

5. The hitting harness of claim 3 wherein the arm tethers extend from the upper arm bands to the waist portion.

6. The hitting harness of claim 3 wherein the arm tethers extend from the arm connecting webs to the waist portion.

7. A method of training the muscles used during hitting and swinging motions comprising:

providing a harness, the harness comprising an arm portion, the arm portion comprising one or more arm members for engaging one or both of a trainee's arms, a waist portion for engaging a midsection of the trainee's body, a leg portion, the leg portion comprising a pair of leg members, each leg member including a thigh band adapted for positioning around the trainee's thigh and connected to the waist portion by a leg connecting web, a resilient and extensible arm tether extending from each arm member to the waist portion, and a resilient and extensible leg tether extending from the leg connecting web of each leg member for connection to a restraint structure;

causing the arm portion to be secured to one or both of the trainee's arms;

causing the waist portion to be secured to the trainee's midsection;

causing the leg portion to be secured to one or both of the trainee's legs;

causing each leg tether to be connected to a restraint structure;

causing the trainee to engage in a desired hitting or swinging motion so that each arm tether and leg tether provides resistance to the trainee's muscles in the sequence used to complete the desired motion.

8. The method of claim 7 wherein causing each leg tether to be connected to a restraint structure includes connecting each tether to a restraint structure on a floor.

9. The method of claim 8 wherein connecting each tether to a restraint structure on a floor includes connecting the tether to restraint structures on opposite sides of the trainee.

10. The harness of claim 1 wherein each leg tether is connected to a floor.

11. The harness of claim 10 wherein the leg tethers are connected to the floor on opposite sides of the trainee.

* * * * *